US009855455B1

(12) United States Patent
Rohanna

(10) Patent No.: US 9,855,455 B1
(45) Date of Patent: Jan. 2, 2018

(54) SUPPLE EXERCISER

(71) Applicant: Daniel J. Rohanna, New York, NY (US)

(72) Inventor: Daniel J. Rohanna, New York, NY (US)

( * ) Notice: Subject to any disclaimer, the term of this patent is extended or adjusted under 35 U.S.C. 154(b) by 21 days.

(21) Appl. No.: 14/995,866

(22) Filed: Jan. 14, 2016

Related U.S. Application Data

(63) Continuation-in-part of application No. 14/289,288, filed on May 28, 2014.

(51) Int. Cl.

| | |
|---|---|
| ***A63B 21/16*** | (2006.01) |
| ***A63B 21/02*** | (2006.01) |
| ***A63B 21/00*** | (2006.01) |
| ***A63B 21/06*** | (2006.01) |
| ***A63B 23/12*** | (2006.01) |
| ***A63B 24/00*** | (2006.01) |

(52) U.S. Cl.
CPC ..... *A63B 21/028* (2013.01); *A63B 21/0004* (2013.01); *A63B 21/0607* (2013.01); *A63B 21/4023* (2015.10); *A63B 21/4039* (2015.10); *A63B 21/4043* (2015.10); *A63B 23/12* (2013.01); *A63B 24/0062* (2013.01); *A63B 2230/75* (2013.01)

(58) Field of Classification Search
CPC ... A63B 21/00; A63B 21/028; A63B 21/4023; A63B 21/4039; A63B 21/4043; A63B 21/0004; A63B 21/0607; A63B 23/12; A63B 24/0062; A63B 2230/75; A63B 23/16; A63B 21/4035; A63B 21/05; A63B 23/14
USPC ..... 482/148, 44–50; 606/240; 222/206; 239/8
See application file for complete search history.

(56) References Cited

U.S. PATENT DOCUMENTS 3,265,389 A * 8/1966 Carlson ..... A63B 23/16 482/49
3,542,363 A * 11/1970 Smith ..... A63B 23/16 482/49
3,637,205 A * 1/1972 Bankston ..... A63B 21/012 473/558
3,910,572 A * 10/1975 Denler ..... A63B 23/16 251/205
4,051,981 A * 10/1977 Mandlak ..... B05B 11/041 209/253

(Continued)

*Primary Examiner* — Andrew S Lo
(74) *Attorney, Agent, or Firm* — Seth Natter; Natter & Natter

(57) ABSTRACT

A hand held supple exerciser is configured with a truncated prolate spheroid body having a transverse radial flange projecting from a closed end and a cylindrical cavity at the other end. Intermediate the ends is a gently curved face. The curved face is dimensioned to be cupped in one's palm for performing underhand or grasped in an overhand orientation for forearm and other exercise routines. The exerciser is molded of a pliable elastic material, such as natural or synthetic rubber, elastomers or blends thereof such that a variety of tension and compression exercise routines may be performed at the cylindrical cavity end while the radial flange at the closed end transitions to an annular channel which functions as a finger grip surface. An internal metal weight is positioned to provide an appropriate center of mass as well as for fixing the total weight of the exerciser.

20 Claims, 3 Drawing Sheets

(56) References Cited

U.S. PATENT DOCUMENTS 4,223,477 A * 9/1980 Abernathy ..... A01G 27/006 239/104
4,538,806 A 9/1985 Wilkerson
4,711,445 A * 12/1987 Whitehead ..... A63B 23/16 482/49
4,712,792 A 12/1987 Rogall
5,011,135 A 4/1991 Patik
5,062,625 A * 11/1991 Vonk ..... A63B 21/0004 482/48
5,824,013 A * 10/1998 Allen ..... A61F 5/01 128/845
5,890,999 A * 4/1999 Kildani ..... A63B 21/00189 482/121
6,179,751 B1 * 1/2001 Clears ..... A63B 21/0004 482/44
6,770,011 B1 * 8/2004 Hinds ..... A63B 21/0004 482/121
6,817,967 B1 * 11/2004 Ott ..... A63B 21/0004 482/47
6,820,571 B2 * 11/2004 Cory ..... A01K 15/02 119/665
7,037,240 B2 * 5/2006 Pemberton ..... A63B 21/028 482/121
8,118,719 B1 * 2/2012 Stassi ..... A63B 21/0555 482/124
D746,389 S * 12/2015 Rohanna ..... D21/680
2003/0069109 A1 * 4/2003 Bender ..... A63B 21/028 482/49
2006/0138154 A1 * 6/2006 Essel ..... B65D 81/3886 220/737
2009/0020622 A1 * 1/2009 Walker, Jr. ..... B05B 7/1486 239/8
2009/0156367 A1 * 6/2009 Harris, Jr. ..... A63B 21/0004 482/49
2012/0018442 A1 * 1/2012 Bollis ..... B65D 81/3879 220/739
2016/0021839 A1 * 1/2016 Blahnik ..... A01H 1/02 239/8

* cited by examiner

Fig. 1
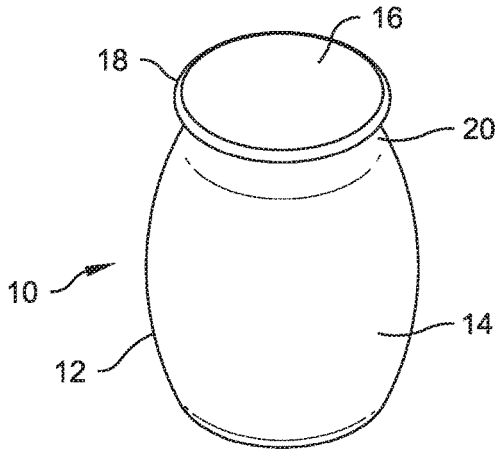
Fig. 2
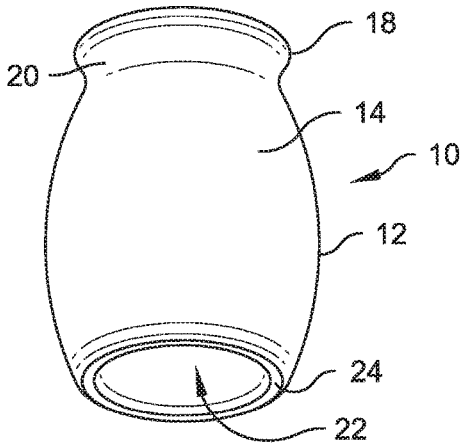
Fig. 3
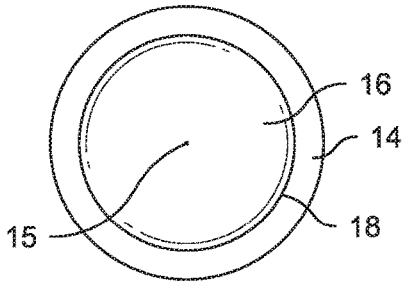
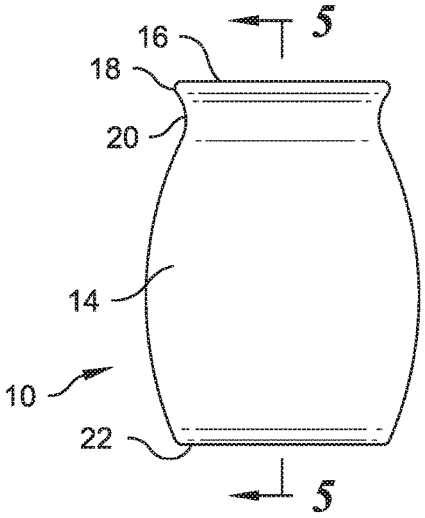
Fig. 4
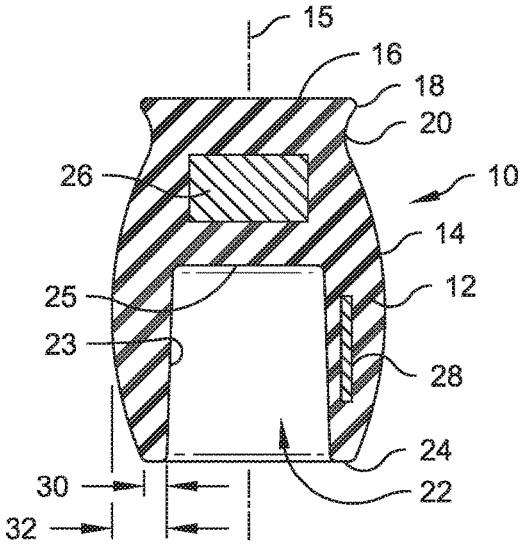
Fig. 5

SUPPLE EXERCISER

RELATED APPLICATION

The present application is a continuation-in-part of application Ser. No. 14/289,288, Filed May 28, 2014 for an invention entitled Free Weight With Ridged Grip.

FIELD OF THE INVENTION

The present invention relates generally to exercising and stress relieving devices and more particularly to a hand manipulated device for providing exercise of the muscles of the hand, wrist, arm, shoulder and upper body in general.

ANTECEDENTS OF THE INVENTION

Hand-held exercise and stress relief devices have been available for many years. An example was a substantially spherical ball having a pliable outer coating and a flexible or pliable core material. To exercise the hand, the user simply squeezed the device with the fingers. The squeezing action may have provided stress relief for the user. Other hand exercisers possessed the same general spherical shape, but differed in materials. For example, one such hand exerciser comprised a flexible thick latex cover with a viscous gel like core. To exercise the hand, the user simply squeezed and manipulated the device. Resistance to the user's hand flexing was provided by the gel like core.

The hand exercisers of the prior art were generally limited to exercise of the hand muscles associated with grip, i.e., compression and release. A need was perceived for a yieldable hand held exerciser which could be employed for a wide variety of routines providing beneficial exercises for a variety of muscle groups.

SUMMARY OF THE INVENTION

An ergonometric hand held multifunction supple exerciser is configured with a truncated prolate spheroid body, in the general shape of a barrel, having a transverse radial flange projecting from a closed end and a cylindrical cavity at the other end. Intermediate the end is a gently curved face. The curved face is dimensioned to be cupped in one's palm for performing underhand or grasped in an overhand orientation for forearm and other exercise routines as one might exercise with a dumbbell. The exerciser is molded of a pliable elastic material, such as natural or synthetic rubber, elastomers or blends thereof such that a variety of tension and compression exercise routines may be performed at the cylindrical cavity end while the radial flange at the closed end forms an annular channel which functions as a finger grip surface. An internal metal weight is positioned to provide an appropriate center of as well as for fixing the total weight of the exerciser.

From the foregoing compendium, it will be appreciated that a feature of the present invention is to provide an ergonometric supple exerciser of the general character described which is not subject to the disadvantages of the aforementioned antecedents of the invention.

An aspect of the present invention is to provide an ergonometric supple exerciser of the general character described which facilitates a wide variety of exercise routines.

A consideration of the present invention is to provide an ergonometric supple exerciser of the general character described which is easy to use.

A further feature of the present invention is to provide an ergonometric supple exerciser of the general character described which is relatively low in cost and suitable to economical mass production fabrication.

Another consideration of the present invention is to provide an ergonometric supple exerciser of the general character described which is configured for employment in the exercise of the muscles of the hand, wrist, arm, shoulder and upper body in general.

A further aspect of the present invention is to provide an ergonometric supple exerciser of the general character described which is resilient and elastically deformable in response to both compressive and tensile forces applied during exercise routines.

An additional consideration of the present invention is to provide a hand held ergonometric supple exerciser of the general character described having a concentrated mass for adding additional challenge into complex sweeping and dynamic movements like dance, yoga, or shadowboxing.

To provide an ergonometric supple exerciser of the general character described formed of rubber or elastomer and having a truncated prolate spheroid body with a cavity at one end is a further consideration of the present invention.

An additional consideration of the present invention is to provide an ergonometric supple exerciser of the general character described formed of rubber or elastomer and having a truncated prolate spheroid body with a radial finger grip flange at one end.

A still further feature of the present invention is to provide an ergonometric supple exerciser of the general character described which may be grasped in one's palm for performing forearm and other exercise routines as one might exercise with a dumbbell.

Yet another aspect of the present invention is to provide an ergonometric supple exerciser of the general character described molded of rubber or elastomer over an internal weight and having a truncated prolate spheroid body.

To provide an ergonometric supple exerciser of the general character described which facilitates exercises that employ a range of grips to target not only the muscles in the hand, but also the muscles for stability, dexterity and for training the whole body as a complete unit is a further consideration of the present invention.

Other aspects, features and considerations of the present invention in part will be readily apparent and in part will be pointed out hereinafter.

With these ends in view, the invention finds embodiment in various combinations of elements, arrangements of parts and series of steps by which the above-mentioned aspects, features and considerations and certain other aspects, features and considerations are attained, or with reference to the accompanying drawings and the scope of which will be more particularly pointed out and indicated in the appended claims.

BRIEF DESCRIPTION OF THE DRAWINGS

In the accompanying drawings, in which are shown an exemplary embodiment of the present invention:

FIG. 1 is an isometric view of a supple exerciser constructed in accordance with and embodying the invention and illustrating a radial finger grip flange extending from a closed planar end which is transverse to a major axis, FIG. 2 is an isometric view of the supple exerciser taken in an upward direction and showing a cylindrical cavity at an end opposite the closed end, FIG. 3 is a top plan view thereof, FIG. 4 is an elevational view thereof, FIG. 5 is a sectional view taken along the plane 5-5 of the major axis and showing an internal weight.

DETAILED DESCRIPTION

Figure 6:
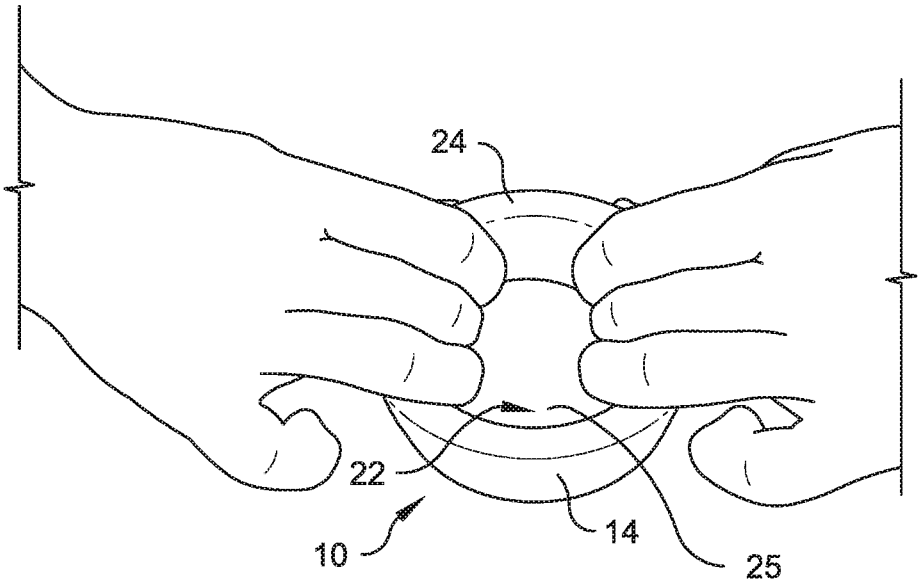
FIG. 6 is a top plan view illustrating a hand and finger exercise routine applying opposed tensile forces at the end opposite the closed end.

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements.

Moreover, where certain elements of the present invention can be partially or fully implemented using known components, only those portions of such known components that are necessary for an understanding of the present invention will be described, and detailed descriptions of other portions of such known components will be omitted so as not to obscure the invention. In the present specification, an embodiment showing a singular component should not be considered limiting; rather, the invention is intended to encompass other embodiments including a plurality of the same component, and vice-versa, unless explicitly stated otherwise herein.

Moreover, applicant does not intend for any term in the specification or claims to be ascribed an uncommon or special meaning unless explicitly set forth as such. Further, the present invention encompasses present and future known equivalents to the known components referred to herein by way of illustration.

Referring now in detail to the drawings wherein like numerals have been employed to denote like components throughout, the reference numeral 10 denotes generally an ergonometric supple exerciser constructed in accordance with and embodying the instant invention. The supple exerciser comprises a pliant body 12, preferably molded in one piece unitary construction of a suitable material which possesses both tactile and elastic attributes, such as, gum rubber, silicone rubber, elastomers and combinations thereof.

In accordance with the invention, the body 12 is configured with a truncated prolate spheroid shape, similar to that of a barrel, and is symmetrical about its major axis 15. The body 12 includes is dimensioned to fit comfortably in the palm of a user, with a curved face 14, having an arc radius of approximately 15 cm in planes coincident with the major axis 15 and a maximum diameter transverse to the major axis of approximately 11 cm. Of course, all dimensions can be proportionately varied to provide supple exercisers which fit comfortably in hands which are sized smaller or larger and the Young's modulus of the material selected should be appropriate for the strength of the intended user. The curved face 14 may be cupped in one's palm for performing underhand or grasped in an overhand orientation for forearm and other exercise routines.

One end of the body 12 is formed of a planar surface 16 which is transverse to the major axis 15 of the body. The planar surface 16 includes a flange 18 which extends radially beyond the curved face 14 such that an annular neck or channel 20 is transitions between the flange 18 and the curved face 14. The neck or channel 20 may function as a grip surface for one's finger tips when employing the supple exerciser in accordance with the invention as will be pointed out hereinafter.

With attention now directed to the opposite end of the body 12 it will be noted from an examination of FIG. 2 and FIG. 5, that there is provided a cavity 22 having a substantially cylindrical internal lateral wall 23. The cavity 22 extends from an opening at an annular rim 24 into the body 12 and terminates at an end wall 25. The cavity 22 and the rim 24 are both concentric with the major axis 15 and the total body length at the major axis is approximately 14 cm with the cavity 22 extending approximately 7 cm into the body 12. As will be noted from an examination of FIG. 5, the thickness of the body between the internal lateral wall 23 and the curved face 14 varies along the length of the major axis 15 from a minimum thickness 30 to a maximum thickness 32.

Also illustrated in FIG. 5 is an optional solid internal mass 26, e.g. a metal weight, which may be selected from a plurality of different weights, so a variety of supple exercisers having different total weights may be provided with the weight and location of the mass selected to provide an optimal center of mass for the supple exerciser 10. The body 12 may be molded over the mass 26. Alternately, the mass 26, or liquid, sand, metal balls, etc., may be enclosed in an enlarged internal chamber for shiftable weight distribution during exercise procedures.

With reference again to FIG. 5, it should be noted that the supple exerciser carries a wireless sensing and transmitting device 28 which may include a strain a gauge and/or a motion sensor as well as other sensors for sensing the user's real time exercise energy expenditure and transmitting the sensed data to a smartphone or other device for recordation, processing and analysis.

It will be appreciated that in accordance with the invention, a wide variety of exercises may be performed by variation of the manner in which the supple exerciser is held or gripped. One possible grip position is a cup position, i.e., to cup one or both hands around the curved face 14.

Another grip position is an end grip position, i.e., a hand is employed to grasp around the planar surface 16 or the annular rim 24, with one's fingers reaching the adjacent areas of the curved face 14.

A further grip position is a pinch position, i.e., to grasp the annular channel 20 with one's fingertips and possibly alternating the gripping fingers.

Another grip position, illustrated in FIG. 6, is to extend fingers inside the cavity 22 and to pull in opposite directions, creating opposing lines of tension, which engages the upper back and shoulder girdle stabilizing muscles. A variation of this grip is to simultaneously urge the heel or base on one's palm against the face 14, applying a compressive force. The fingers of a single hand may also be inserted into the cavity and spread radially outwardly. The extent of resilient stretching of the supple exerciser 10 will be dependent upon the forces applied.

Figure 7:
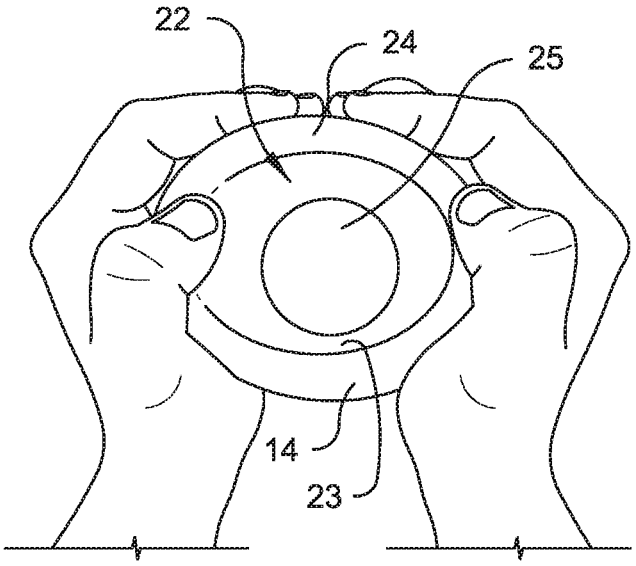
FIG. 7 is a top plan view of a different exercise routine applying compressive force at the end opposite the closed end.
Figure 8:
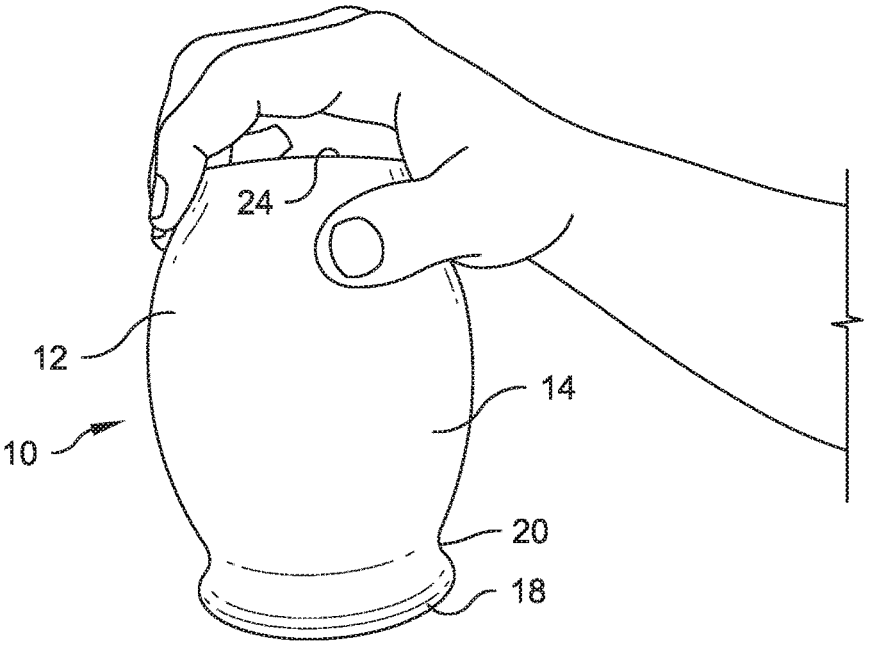
FIG. 8 is an elevational view of a different exercise routine applying compressive force at the end opposite the closed end.
Figure 9:
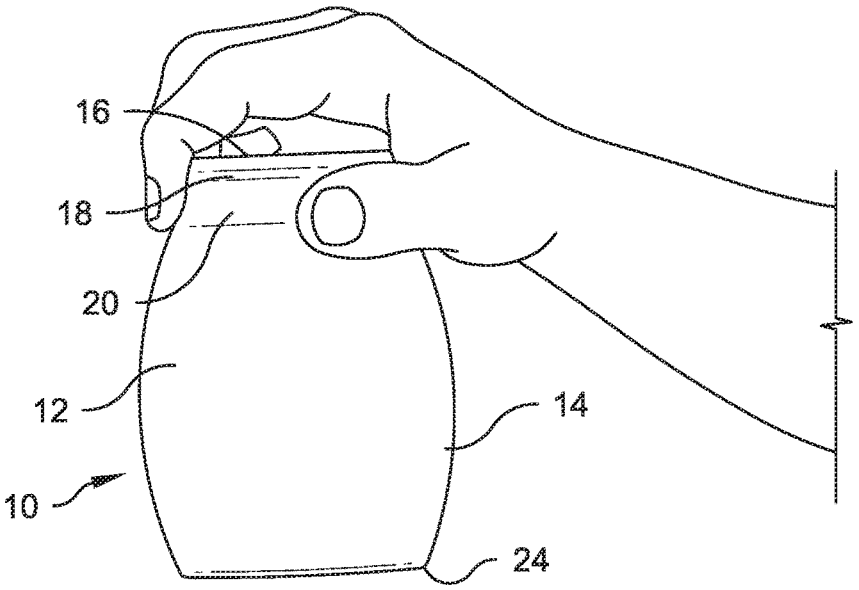
FIG. 9 is an elevational view of a different exercise routine gripping the supple exerciser with fingertips in an annular channel adjacent the closed end.

A further grip position, illustrated in FIG. 7 is to grasp the curved face 14 adjacent the cavity 22 with two hands, and apply compressive force. In FIG. 8, the compressive force is applied with one hand positioned over the cavity 22. The supple exerciser may also be employed in various compression exercises. For example, the supple exerciser may be positioned between open palms, with the annular rim 24 abutting one palm and the planar surface 16 abutting the other palm. The palms are then urged together to apply compressive force. The annular rim or planar surface may also rest on a support surface and compressive force applied with a single hand. A further variation is to rest the planar surface 16 on a support surface and insert one's hand or fingers into the cylindrical cavity 22.

A further compressive force grip, illustrated in FIG. 8, is to grasp around the annular rim 24, with one's fingers reaching the face 14 and with the heel of one's palm abutting the opposite side of the face, the fingers and heel are then squeezed together, elastically deforming the supple exerciser.

The supple exerciser may also be employed by being balanced on one's hand while performing a variety of different body movements.

A variety of hand exercises may be attained by transitioning between the various grip positions, i.e., cup, end grip and pinch while holding the supple exerciser in one hand as well as employing finger manipulation for rotating the supple exerciser.

A further exercise is to start in the pinch position and toss the supple exerciser into air, completing half rotations and full rotations, while attempting to catch in the pinch position or cup position. The supple exerciser can also be held in one's hand and manipulated during a variety of body exercises including, for example, unilateral or bilateral multi-directional extension and retraction of the upper extremity while maintaining the static flexion/extension angle of the upper extremity joint articulations during movement, during simulated swimming movements, when swinging one's arm while simultaneously using any joint of the upper extremity as a fixed point to create dynamic movement.

The supple exerciser may also be employed as a counterbalance to help balance weight distribution and shifts in the body during dynamic movements as well as when in fixed positions. In an additional exercise routine, the supple exerciser can be held in one's hand and shook in different directions rotationally, horizontally, and vertically.

The supple exerciser is also configured for compression and torque exercises such as grasping the supple exerciser between two hands, with the annular rim 24 abutting one palm and the planar surface 16 abutting the other palm the squeezing while twisting in opposite directions.

Any surface of the supple exerciser may be placed against a support surface for various compression exercises. By positioning the planar surface 16 or the rim 24 on a floor, the supple exerciser may be employed as a touch point for balancing body weight.

The supple exerciser may be beneficially employed in combination with full body fundamental movements employing the various grip positions, for example, both static and dynamic squats, e.g. squat staggered stance with unilateral post and body compression, lunges as well as hip hinge routines, movement matrix routines including those with multi plane foot positions, progressions and regressions, isotonic exercise, dynamic exercise and exercise cues. Thus it will be seen that there is provided a supple exerciser which achieves the various aspects, features and considerations of the present invention and which is well suited to meet the conditions of practical usage.

In the figures of this application, in some instances, a plurality of elements may be shown as illustrative of a particular element, and a single element may be shown as illustrative of a plurality of a particular elements. Showing a plurality of a particular element is not intended to imply that a system or method implemented in accordance with the invention must comprise more than one of that element or step, nor is it intended by illustrating a single element that the invention is limited to embodiments having only a single one of that respective element. Those skilled in the art will recognize that the numbers of a particular element shown in a drawing can, in at least some instances, be selected to accommodate the particular user needs.

The particular combinations of elements and features in the above-detailed embodiment are exemplary only; the interchanging and substitution of these teachings with other teachings in this application are also expressly contemplated. As those skilled in the art will recognize, variations, modifications, and other implementations of what is described herein can occur to those of ordinary skill in the art without departing from the spirit and the scope of the invention as claimed.

Further, in describing the invention and in illustrating embodiments of the invention in the figures, specific terminology, numbers, dimensions, materials, etc., are used for the sake of clarity. However the invention is not limited to the specific terms, numbers, dimensions, materials, etc. so selected, and each specific term, number, dimension, material, etc., at least includes all technical and functional equivalents that operate in a similar manner to accomplish a similar purpose. Use of a given word, phrase, number, dimension, material, language terminology, product brand, etc. is intended to include all grammatical, literal, scientific, technical, and functional equivalents. The terminology used herein is for the purpose of description and not limitation.

Having described the preferred embodiment of the invention, it will now become apparent to one of ordinary skill in the art that other embodiments incorporating the concept may be used. Moreover, those of ordinary skill in the art will appreciate that the embodiment of the invention described herein can be modified to accommodate and/or comply with changes and improvements in the applicable technology and standards referred to herein.

For example, the technology can be implemented in many other, different, forms, and in many different environments, and the technology disclosed herein can be used in combination with other technologies. Variations, modifications, and other implementations of what is described herein can occur to those of ordinary skill in the art without departing from the spirit and the scope of the invention as claimed. It is felt therefore that these embodiments should not be limited to the disclosed embodiment but rather should be limited only by the spirit and scope of the appended claims.

Having thus described the invention, there is claimed as new and desired to be secured by Letters Patent:

1. An ergonometric supple exerciser comprising a body formed of a yieldable material, the body being configured to be gripped by a user's hand, the body having a major axis, a face dimensioned to fit in a palm of the user and a cavity having an opening formed only at one end of the body, the body being closed at its opposite end, the cavity having an internal lateral wall, the body being symmetrical about the major axis, the body being formed with a truncated prolate spheroid shape, the body including a rim surrounding the cavity opening, the rim lying in a plane transverse to the major axis, the body thickness between the internal lateral wall and the face varying along the major axis.

2. An ergonometric supple exerciser as constructed in accordance with claim 1 wherein the body is molded over a weight, whereby a center of mass suitable for exercising is attained.

3. A method of exercising various muscle groups with the ergonometric supple exerciser as constructed in accordance with claim 1, the method comprising the steps of:

a) gripping and holding the ergonometric supple exerciser by engaging the face in the palm of one hand;

b) performing exercise routines while holding the ergonometric supple exerciser; and c) releasing the ergonometric supple exerciser when the exercise routines have been completed.

4. A method of exercising various muscle groups with an ergonometric hand held supple exerciser as constructed in accordance with claim 1, the supple exerciser being molded of a yieldable material selected from the group consisting of rubbers, elastomers and combinations thereof, the exerciser having a stress free configuration, the method comprising the step of elastically deforming the supple exerciser with compressive or tensile forces applied by at least one hand to areas in registration with the cavity.

5. A method of exercising various muscle groups in accordance with claim 4 wherein the cavity includes the internal lateral wall, the exerciser being elastically deformed in the presence of forces applied against the internal lateral wall by at least one hand.

6. A method of exercising various muscle groups in accordance with claim 4, the method further comprising the steps of:

a) applying opposed compressive forces to an area of the face in registration with the cavity, the compressive forces being directed toward the major axis; and b) permitting the supple exerciser to return to its stress free configuration by releasing the compressive forces.

7. A method of exercising various muscle groups in accordance with claim 5, the method further comprising the steps of:

a) inserting one or more fingers of two hands through the opening and into the cavity;

b) engaging the internal lateral wall with the one or more fingers of each hand;

c) pulling the hands apart; and d) permitting the supple exerciser to return to its stress free configuration by releasing the pulling forces.

8. An ergonometric supple exerciser as constructed in accordance with claim 1 wherein the cavity includes an end wall transverse to the major axis.

9. An ergonometric supple exerciser as constructed in accordance with claim 8 wherein the cavity extends from the rim to the end wall a distance approximately one half the length of the body at the major axis.

10. An ergonometric supple exerciser comprising a body formed of a yieldable material, the body being configured to be gripped by a user's hand, the body having a major axis, a face dimensioned to fit in a palm of the user and a cavity formed at one end of the body, the body being symmetrical about the major axis, the body being formed with a truncated prolate spheroid shape, the body including a rim surrounding the cavity, the rim lying in a plane transverse to the major axis, the supple exerciser further including a radial flange projecting from another end of the body and an annular transition channel between the radial flange and the face, the transition channel being dimensioned to receive the fingertips of a user's hand when the body is grasped at the other end.

11. A method of exercising various muscle groups with the ergonometric supple exerciser as constructed in accordance with claim 10, the method comprising the steps of:

a) gripping and holding the ergonometric supple exerciser by engaging the fingertips of one hand in the transition channel;

b) performing exercise routines while holding the ergonometric supple exerciser; and c) releasing the ergonometric supple exerciser when the exercise routines have been completed.

12. An ergonometric supple exerciser comprising a body formed of a yieldable material, the body being configured to be gripped by a user's hand, the body having a major axis, a face dimensioned to fit in a palm of the user and a cavity having an opening formed at one end of the body, the body being symmetrical about the major axis, the body being formed with a truncated prolate spheroid shape, the body including a rim surrounding the cavity opening, the rim lying in a plane transverse to the major axis, the supple exerciser further including a device for sensing energy expenditure and for transmitting the sensed data for processing and analysis.

13. An ergonometric hand held supple exerciser comprising a body formed of a yieldable material, the body being configured to be gripped by a user's hand, the body having a major axis, a face dimensioned to fit in a palm of the user and a cavity having an opening formed at one end of the body, the body being symmetrical about the major axis, the body being formed with a truncated prolate spheroid shape, the body including a rim surrounding the cavity opening, the rim lying in a plane transverse to the major axis, the yieldable material being selected from the group consisting of rubbers, elastomers and combinations thereof molded over a solid internal mass, the exerciser being elastically deformed in the presence of compressive forces applied by at least one hand to areas of the face in registration with the cavity.

14. An ergonometric hand held supple exerciser as constructed in accordance with claim 13 wherein the cavity includes an internal lateral wall, the exerciser being elastically deformed in the presence of forces applied against the internal lateral wall by at least one hand.

15. A method of exercising various muscle groups with an ergonometric supple exerciser comprising a body formed of a yieldable material, the body having a major axis, a face dimensioned to fit in a palm of the user and a cavity formed at one end of the body, the cavity having a internal lateral wall, the body being symmetrical about the major axis, the body thickness between the internal lateral wall and the face varying along the major axis, the method comprising the steps of:

a) elastically deforming the supple exerciser from a stress free configuration by applying opposed compressive forces to an area of the face in registration with the cavity, the compressive forces being directed toward the major axis; and b) permitting the supple exerciser to return to the stress free configuration by releasing the compressive forces.

16. A method of exercising various muscle groups with the ergonometric supple exerciser as constructed in accordance with claim 15 wherein steps a) and b) are repeated for a predetermined series of cycles.

17. A method of exercising various muscle groups with the ergonometric supple exerciser as constructed in accordance with claim 16 wherein the compressive forces are applied with two hands.

18. A method of exercising various muscle groups with an ergonometric supple exerciser comprising a body formed of a yieldable material, the body being configured to be gripped by a user's hand, the body having a major axis, a truncated prolate spheroid shape, a face dimensioned to fit in a palm of the user and a cavity having an opening formed at one end of the body, the body being symmetrical about the major axis, the method comprising the steps of:

a) elastically deforming the supple exerciser by inserting one or more fingers of two hands through the opening and into the cavity and pulling the hands apart by applying pulling forces; and b) permitting the supple exerciser to return to its stress free configuration by releasing the pulling forces.

19. A method of exercising various muscle groups in accordance with claim 18, further including the step of:

c) repeating step a) and step b) for a predetermined series of cycles.

20. A method of exercising various muscle groups with the ergonometric supple exerciser comprising a body formed of a yieldable material, the body being configured to be gripped by a user's hand, the body having a major axis, a truncated prolate spheroid shape, a face dimensioned to fit in a palm of the user and a cavity formed at one end of the body, the body being symmetrical about the major axis, the cavity including a substantially cylindrical internal wall, the method comprising the steps of:

a) elastically deforming the supple exerciser from a stress free configuration by inserting fingers of one hand into the cavity and against the substantially cylindrical internal wall and spreading the fingers apart with a spreading force; and b) permitting the supple exerciser to return to the stress free configuration by releasing the spreading force.

* * * * *